US008011548B2

(12) United States Patent
Chang

(10) Patent No.: US 8,011,548 B2
(45) Date of Patent: Sep. 6, 2011

(54) NAIL GUN HAVING SAFE FIRING MECHANISM

(75) Inventor: Jeng-Fang Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 12/654,806

(22) Filed: Jan. 5, 2010

(65) Prior Publication Data

US 2010/0170929 A1 Jul. 8, 2010

(30) Foreign Application Priority Data

Jan. 5, 2009 (TW) ..... 98100081 A

(51) Int. Cl.
*B25C 1/04* (2006.01)

(52) U.S. Cl. ..... 227/8; 227/125; 227/130; 227/138

(58) Field of Classification Search ..... 227/8, 136, 227/137, 138, 125, 130; 81/434, 435
See application file for complete search history.

(56) References Cited

U.S. PATENT DOCUMENTS 5,904,285 A * 5/1999 Anderson et al. ..... 227/115
6,024,268 A * 2/2000 Horng-Lin ..... 227/120
6,170,730 B1 * 1/2001 Lin ..... 227/119
6,308,880 B1 * 10/2001 Ronconi ..... 227/119
6,948,647 B1 * 9/2005 Niblett et al. ..... 227/130
6,966,476 B2 11/2005 Jalbert et al.
7,303,103 B2 * 12/2007 Wang ..... 227/8
7,654,430 B2 * 2/2010 Cho et al. ..... 227/109
7,775,412 B2 * 8/2010 Nemeth ..... 227/147
2006/0118596 A1 * 6/2006 Wojcicki et al. ..... 227/137
2008/0164295 A1 * 7/2008 Wu et al. ..... 227/8

* cited by examiner

*Primary Examiner* — Rinaldi I Rada
*Assistant Examiner* — Eyamindae Jallow
(74) *Attorney, Agent, or Firm* — Bacon & Thomas PLLC

(57) ABSTRACT

A nail gun having a safe firing mechanism is composed of a main body, a nail-driving member, a safety member, and a linkage. The main body includes a nail passage for receiving nails and a nail chamber for receiving a nail ready to be fired by the nail-driving member. The nails include an initial nail, a final nail, and a plurality of standby nails located between the initial and final nails. The linkage includes a contact portion and a stopping end linking up with the contact portion. The contact portion is stopped against the standby nail. The stopping end is stopped against the safety member. When the contact portion is not stopped against the standby nail, the stopping end is located at where the safety member is stopped. When the contact portion is stopped against the standby nail, the stopping end shifts to where the safety member is not stopped.

8 Claims, 8 Drawing Sheets

NAIL GUN HAVING SAFE FIRING MECHANISM

BACKGROUND OF THE INVENTION

1. Field of the Invention

The present invention relates generally to a nail gun, and more particularly, to a nail gun having a safe firing mechanism.

2. Description of the Related Art

To prevent a nail gun from damage while none of any nails is available in the nail gun and a user still fires the nail gun, the nail gun is usually equipped with a safe firing mechanism.

U.S. Pat. No. 6,966,476 disclosed a nail gun having a safe firing mechanism functioning as detecting a coil of nails by a sensor-like mechanism located near a nose portion. The sensor-like mechanism includes a contact piece for contacting each nail moving toward the nose portion, and a safety member stoppable by the contact piece. The contact piece is located near the nose portion and one end of the nail that the contact piece contacts is located inside the nose portion and close to a firing path. When the contact piece contacts one of the nails, the contact piece pivots to no longer stop the safety member, the user can pull the trigger to fire the nail. And then, when the final nail is pushed to the nose portion to be fired, the contact piece pivots back to stop the safety member again and meanwhile, the user cannot pull the trigger. In other words, the sensor-like mechanism can detect whether it is the final nail to identify that there will be none of any nails in the nail gun; if it is not the final nail, the user can still pull the trigger; if it is the final nail, the user cannot pull the trigger in such a way that the nail gun is protected from damage.

However, in the process of pushing the final nail to the firing path, there is no firm holding, e.g. a wire holding the nails, such that it is subject to inaccurate positioning to disable the sensor-like mechanism from accurately identifying whether there will be none of any nails in the nail gun. Under the circumstances, it frequently happens that some of the nails are still available but cannot be fired, such that the user needs to open the nail gun to remove the jammed nail, thus being inconvenient in operation. Besides, while the nail-driving member moves, it will directly impact the contact piece contacting the nail to impair the contact piece in such a way that the safe firing mechanism may malfunction.

SUMMARY OF THE INVENTION

The primary objective of the present invention is to provide a nail gun having a safe firing mechanism, whose parts are not subject to damage and which can be safely operated.

The foregoing objective of the present invention is attained by the nail gun composed of a main body, a nail-driving member, a safety member, and a linkage. The main body includes a nail passage and a nail chamber in communication with the nail passage. The nail passage is provided for receiving a coil of nails. The nail chamber is provided for receiving a nail which is ready to be fired. The nails include an initial nail, a final nail, and a plurality of standby nails located between the initial and final nails. The nail-driving member is movably mounted inside the nail chamber for percussing the nails. The safety member is movably mounted to the nail chamber for upward or downward movement. The linkage is mounted to the main body and includes a contact portion and a stopping end linking up with the contact portion. The contact portion faces the nail passage and is spaced from the nail chamber for a distance of at least one nail to be stopped against the standby nail. The stopping end is stopped against the safety member. When the contact portion is not stopped against the standby nail, the stopping end is not moved by the standby nail to be located at a first position where the safety member is stopped from upward movement. When the contact portion is stopped against the standby nail, the stopping end links up with the standby nail to shift to a second position where the safety member is not stopped.

DETAILED DESCRIPTION OF PREFERRED EMBODIMENTS

Figure 1:
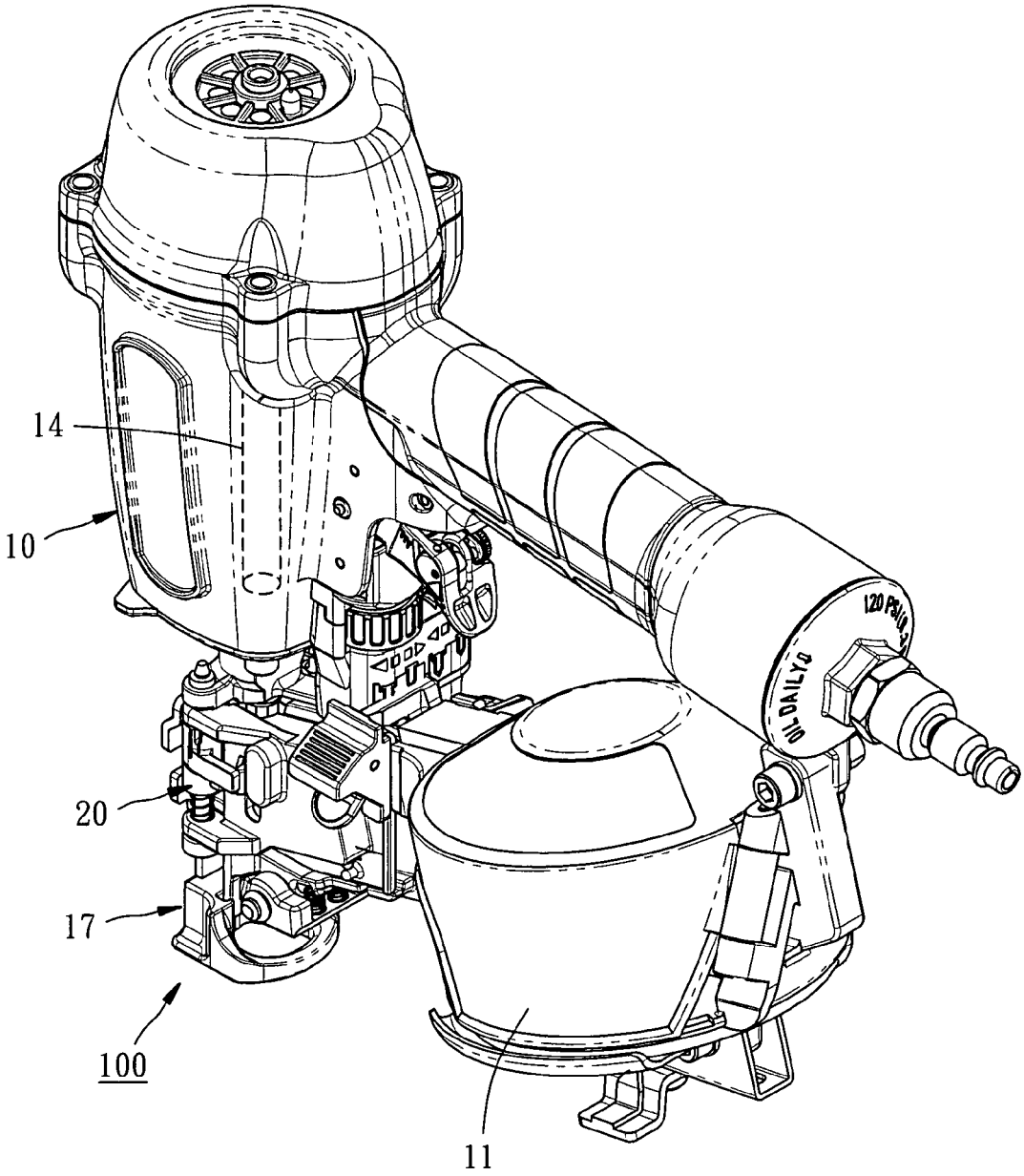
FIG. 1 is a perspective view of a preferred embodiment of the present invention.
Figure 2:
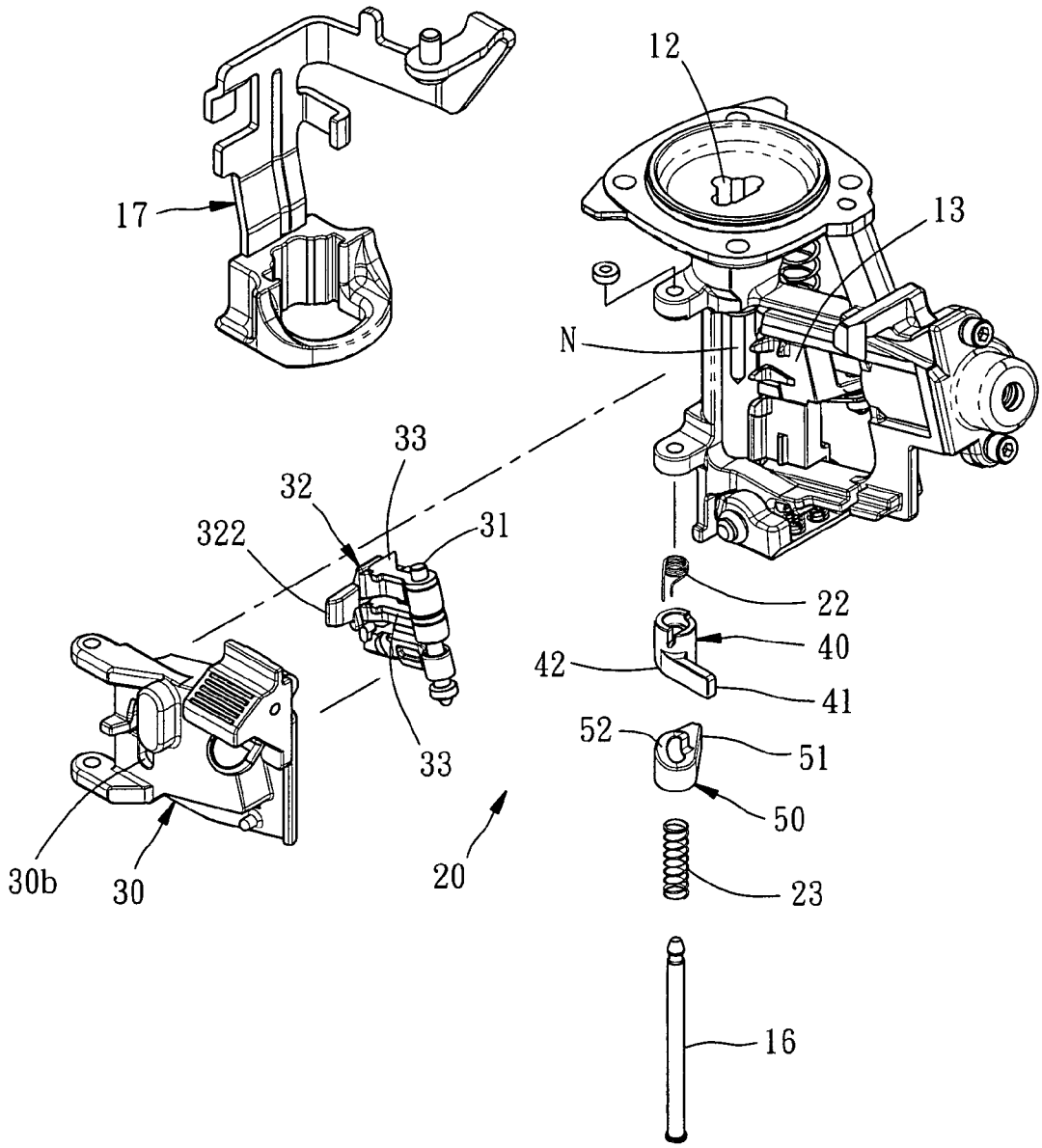
FIG. 2 is an exploded view of the preferred embodiment of the present invention.
Figure 3:
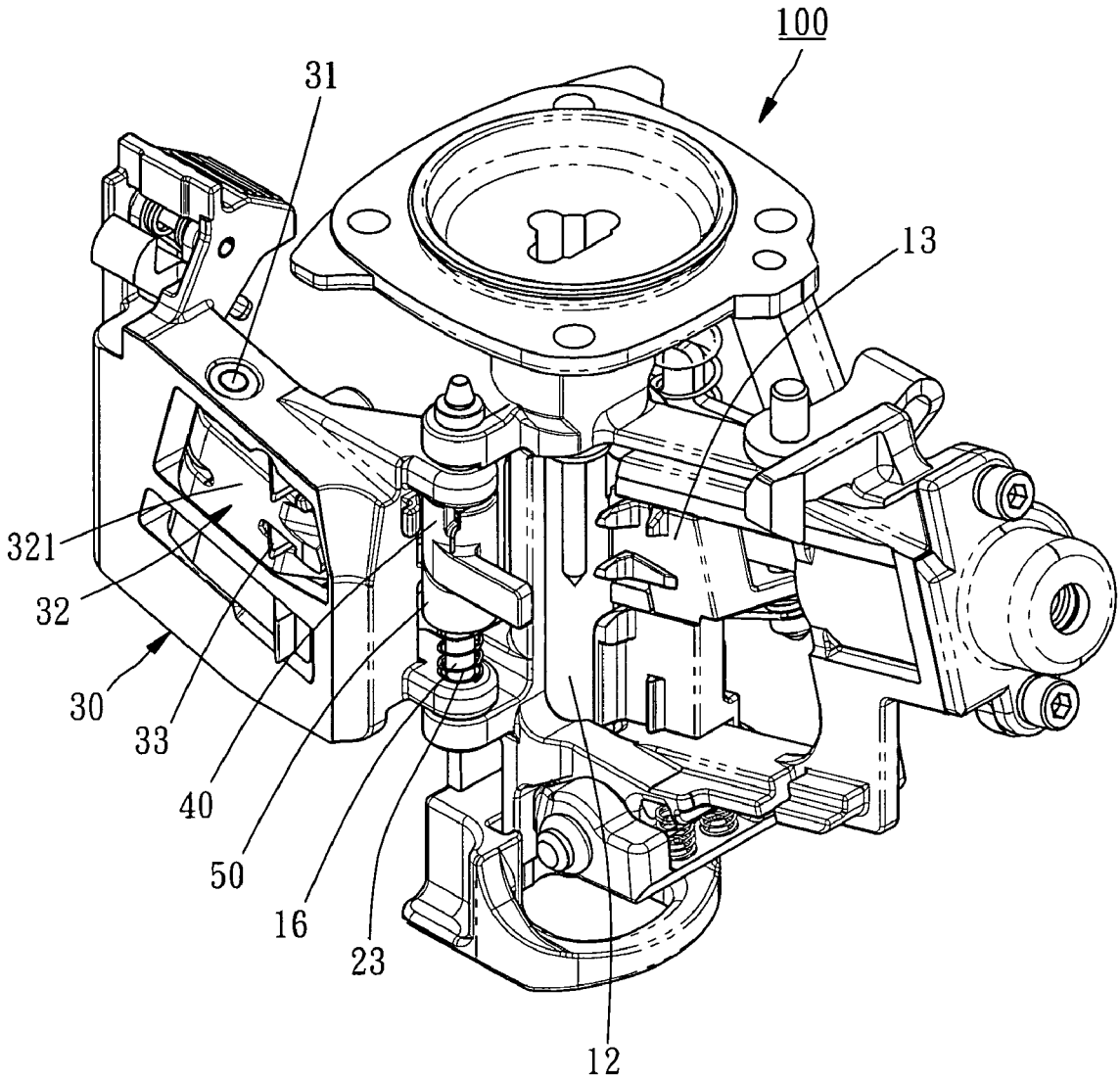
FIG. 3 is another perspective view of the preferred embodiment of the present invention, showing that an upper cover is opened.
Figure 4:
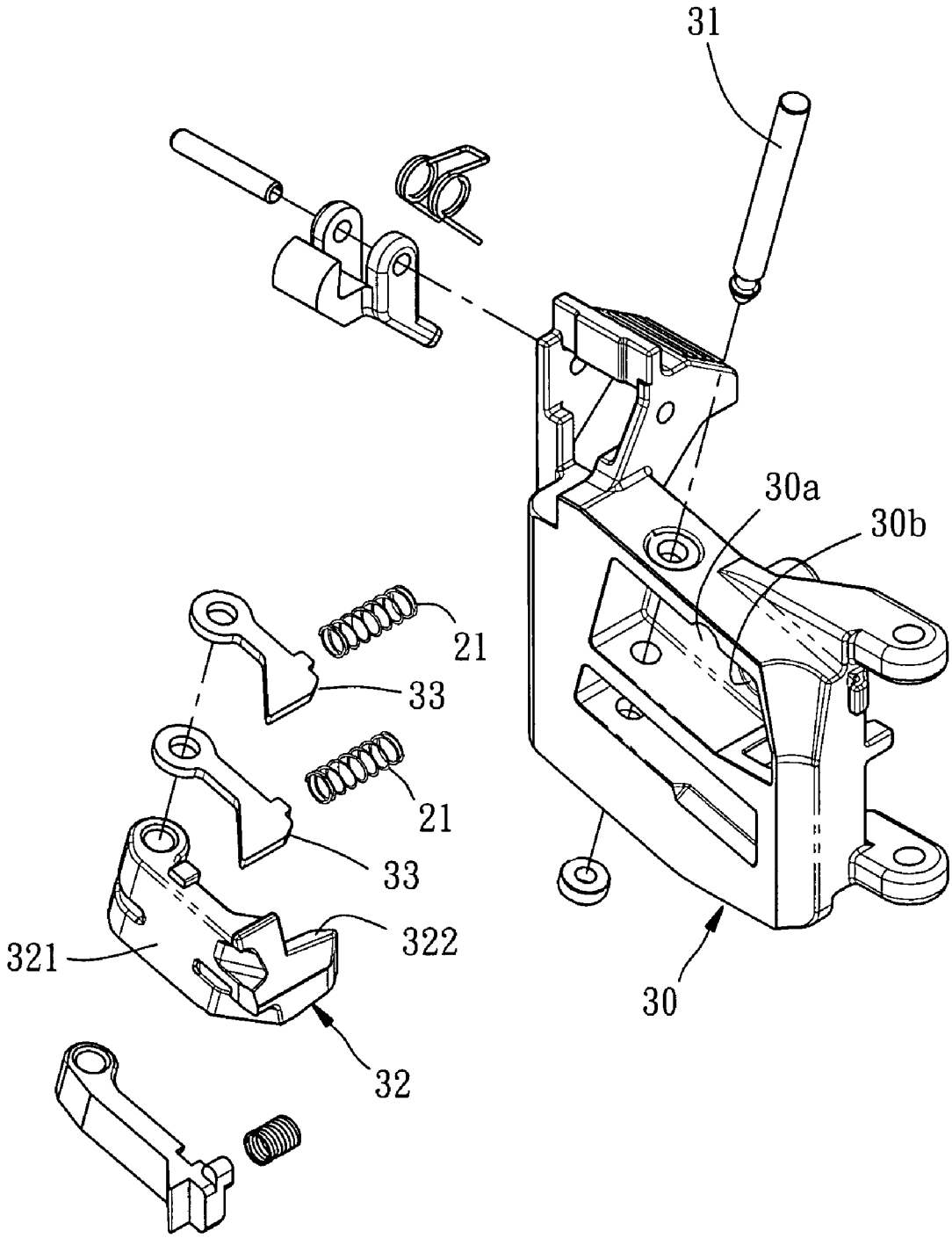
FIG. 4 is an exploded view of the upper cover in accordance with the preferred embodiment of the present invention.
Figure 5:
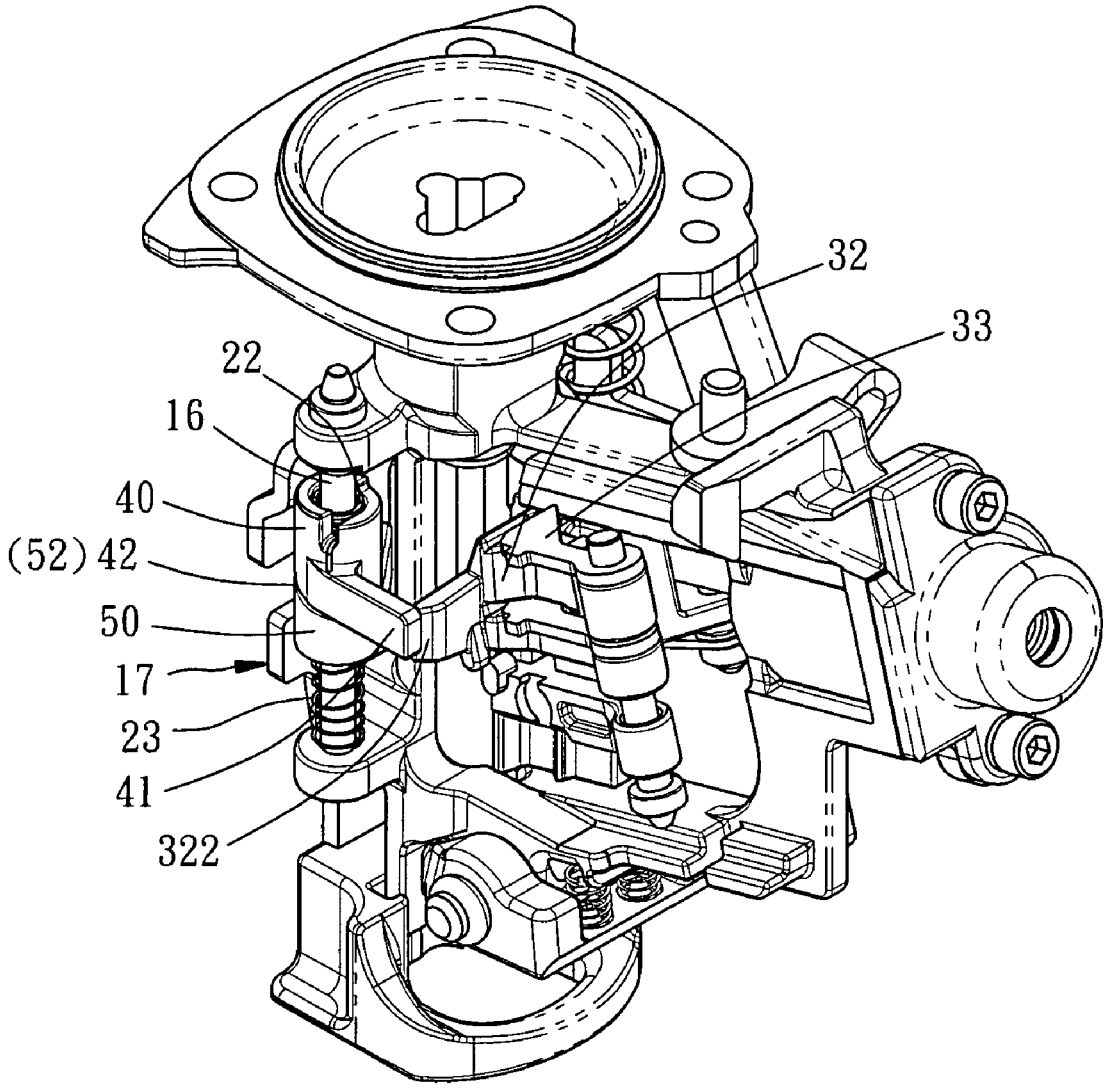
FIG. 5 is another perspective view of the preferred embodiment of the present invention, showing that a contact piece is stopped against a transmission member.

Referring to FIGS. 1-6, nail gun 100 having a safe firing mechanism is composed of a main body 10, a nail-driving member 14, a magnet 15, a safety member 17, and a linkage 20.

The main body 10 includes a magazine 11 having a plurality of nails N, a nail chamber 12 for receiving a coil of the nails N which are ready to be fired, and a nail passage 13 in communication with the magazine 11 and the nail chamber 12 for the nails N to pass through. The nail-driving member 14 is also received in the nail chamber 12, for reciprocating movement driven to percuss the nails N inside the nail chamber 12. The magnet 15 is mounted inside the nail chamber 12 for magnetically attracting and fastening the nails N inside the nail chamber 12. A first axial pin 16 is inserted through an external side of the nail chamber 12. The safety member 17 is movably mounted to a front end of the nail chamber 12, having a stopper 171. A front end of the safety member 17 can be stopped against a workpiece (not shown).

To conveniently specify the present invention, the nails N define that the foremost nail is an initial nail NS, the rearmost nail is a final nail NF, and a plurality of standby nails NU located between the initial nail NS and the final nail NF. Each of the nails N includes a nail tip N1 and a nail body N2. The nail tip N1 of the nail N in the nail chamber 12 is attached to the magnet 15.

The linkage 20 includes an upper cover 30, a transmission member 40, and a stopping member 50. The upper cover 30 is a plate in this embodiment and mounted above the nail passage 13 and can be opened (FIG. 3) or closed (FIG. 4) relative to the nail passage 13. The upper cover 30 has a cavity 30*a* and a through hole 30*b* beside the cavity 30*a*. A contact piece 32 is pivoted to the cavity 30*a* via a second axial pin 31, having a contact portion 321 formed at a bottom side thereof, and a push portion 322 formed at a top front end thereof and extending into the through hole 30*a*. The contact portion 321 faces the nail passage 13 and is spaced from the nail chamber 12 for a distance of at least one nail (actually three in this embodiment), such that the contact portion 321 is just stopped against the standby nails NU. The contact piece 32 has two sharp portions 33 pivoted thereto, and two compression springs 21, one of which has two ends stopped against the two sharp portions 33 respectively and the other of which also has two ends stopped against the sidewall of the cavity 30*a*, in such a way that the contact piece 32 is forced by the resilience of the two compression springs 21 to keep pivoting toward the nail passage 13 and the contact portion 321 is stopped against the standby nails NU in the nail passage. The transmission member 40 is a barrel in this embodiment, having a protrusion 41 and a first bevel 42 formed at a bottom end thereof. A biasing member 22 is fitted to the first axial pin 16, having two ends, one of which is stopped against the upper cover 30 and the other is stopped against the transmission member 40, for providing a biasing force for the protrusion 31 to keep stopped against the push portion 322. It is to be noted that the contact piece 32 is spaced from the nail chamber 12 for the distance of at least one nail and thus the nail-driving member 14 in movement does not directly percuss the push portion 322 and the protrusion 41. Therefore, compared with the prior art, the contact piece 32 and the transmission member 40 are not subject to wear and tear to be highly reliable. The stopping member 50 is a barrel in this embodiment, having a stopping portion 51 and a second bevel 52 corresponding to the first bevel 42. The stopping portion 51 has a stopping end formed at one end thereof for stopping movement of the safety member 17. A torsion spring 23 is fitted to the first axial pin 16, having two ends, one of which is stopped against the upper cover 30 and the other is stopped against a bottom end of the stopping member 50, for providing a recovery force for the stopping member 50 to keep stopped against the transmission member 40, i.e. the second bevel 52 fits the first bevel 42 very tight. It is to be noted that the two-piece design of the stopping member 50 and the transmission member 40 includes an advantage of convenient replacement. In other words, the user may inevitably pull the trigger to enable the safety member 17 to percuss the workpiece, while the nails are run out, in such a way that the stopping portion 41 may be inevitably deformed and damaged to need replacement. Under the circumstances, by means of the present invention, the user only needs to replace the stopping member 50 rather than the whole linkage 20.

Figure 6:
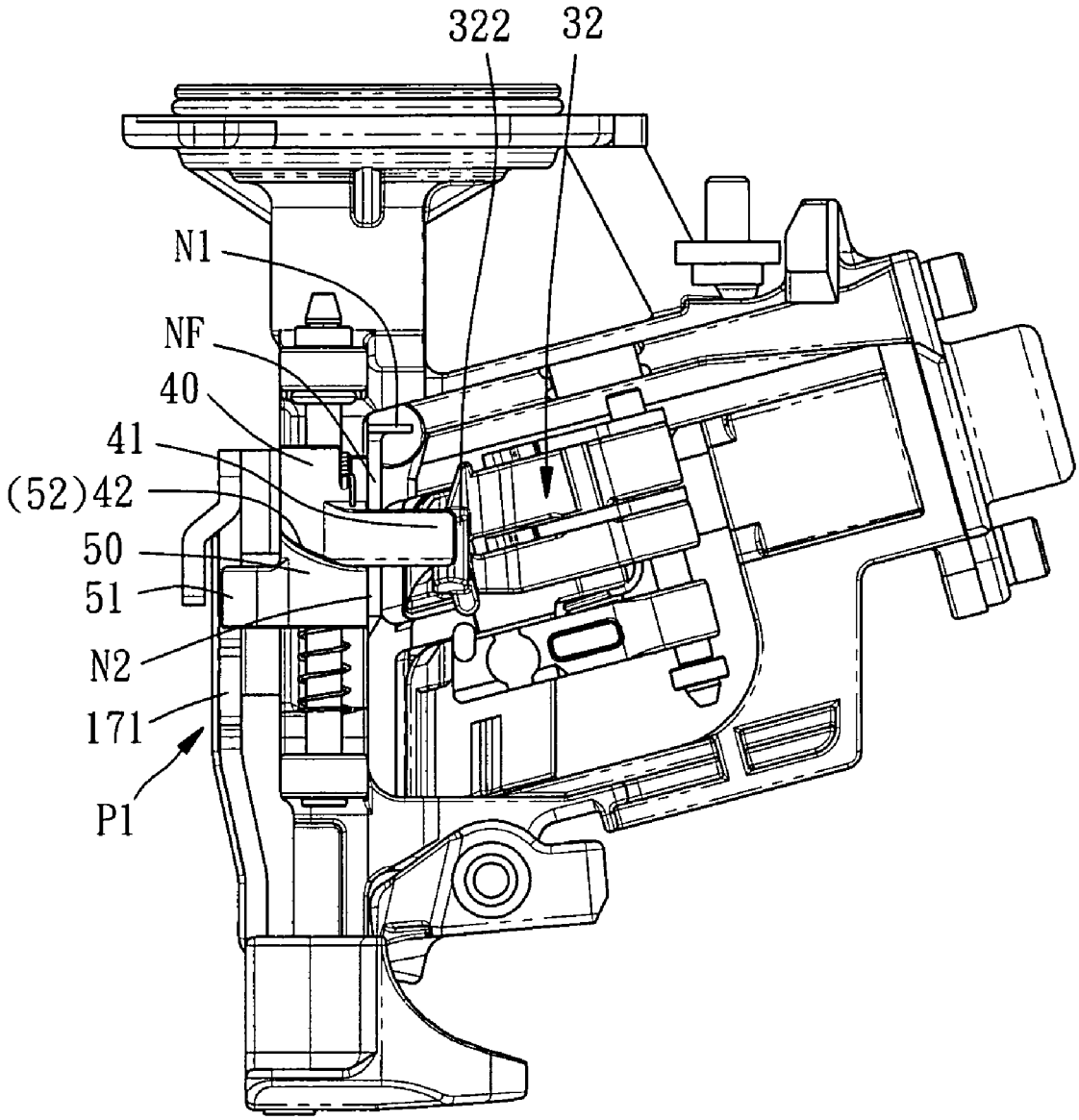
FIG. 6 is a schematic view of the preferred embodiment of the present invention, showing that the contact piece is not stopped against any standby nail.
Figure 7:
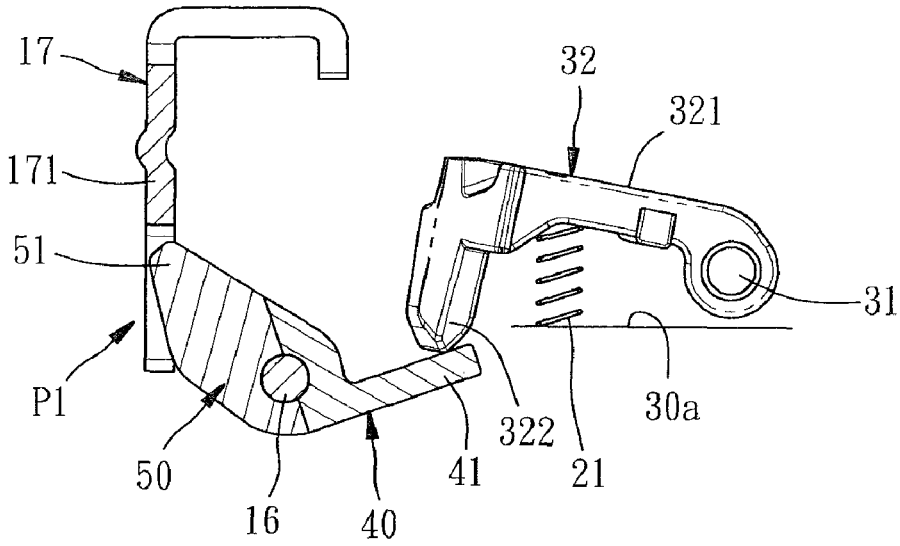
FIG. 7 is another schematic view of the preferred embodiment of the present invention, showing that a stopping member stops a safety member.

Referring to FIGS. 6 and 7, when only the final nail NF is left in the nail passage 13, the contact portion 321 does not contact any standby nail NU, such that the contact piece 32 keeps pivoting toward the nail passage 13. In the meantime, the transmission member 40 is biased and linking-up with the stopping member 50 via the first bevel 42 to keep the stopping portion 51 located at a first position P1 where the stopping portion 51 stops the stopper 171 to stop the safety member 17 from upward movement, such that none of any nails can be fired. Besides, the nail tip N1 of the final nail NF is attracted by the magnet 15 to be fixed in such a way that the final nail NF does not fall off.

Figure 8:
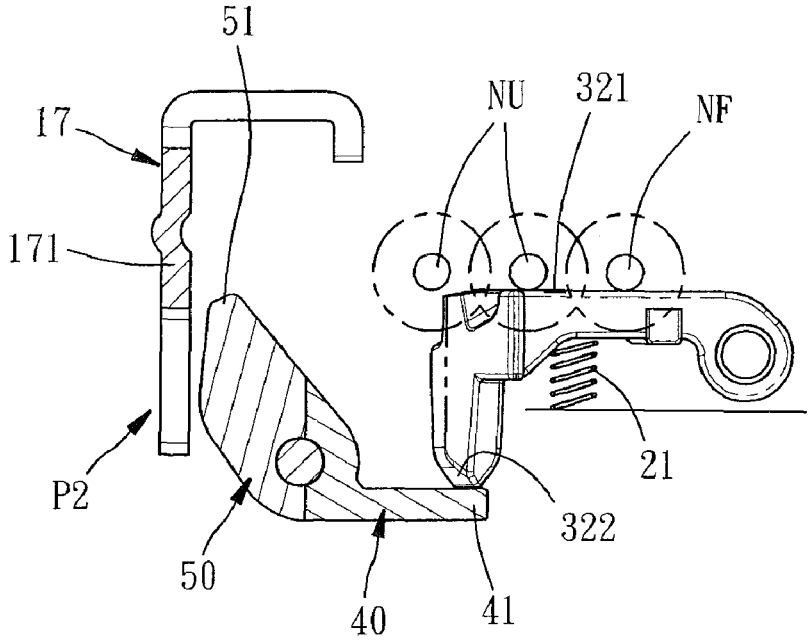
FIG. 8 is a schematic view of the preferred embodiment of the present invention, showing that the stopping member does not stop the safety member.
Figure 9:
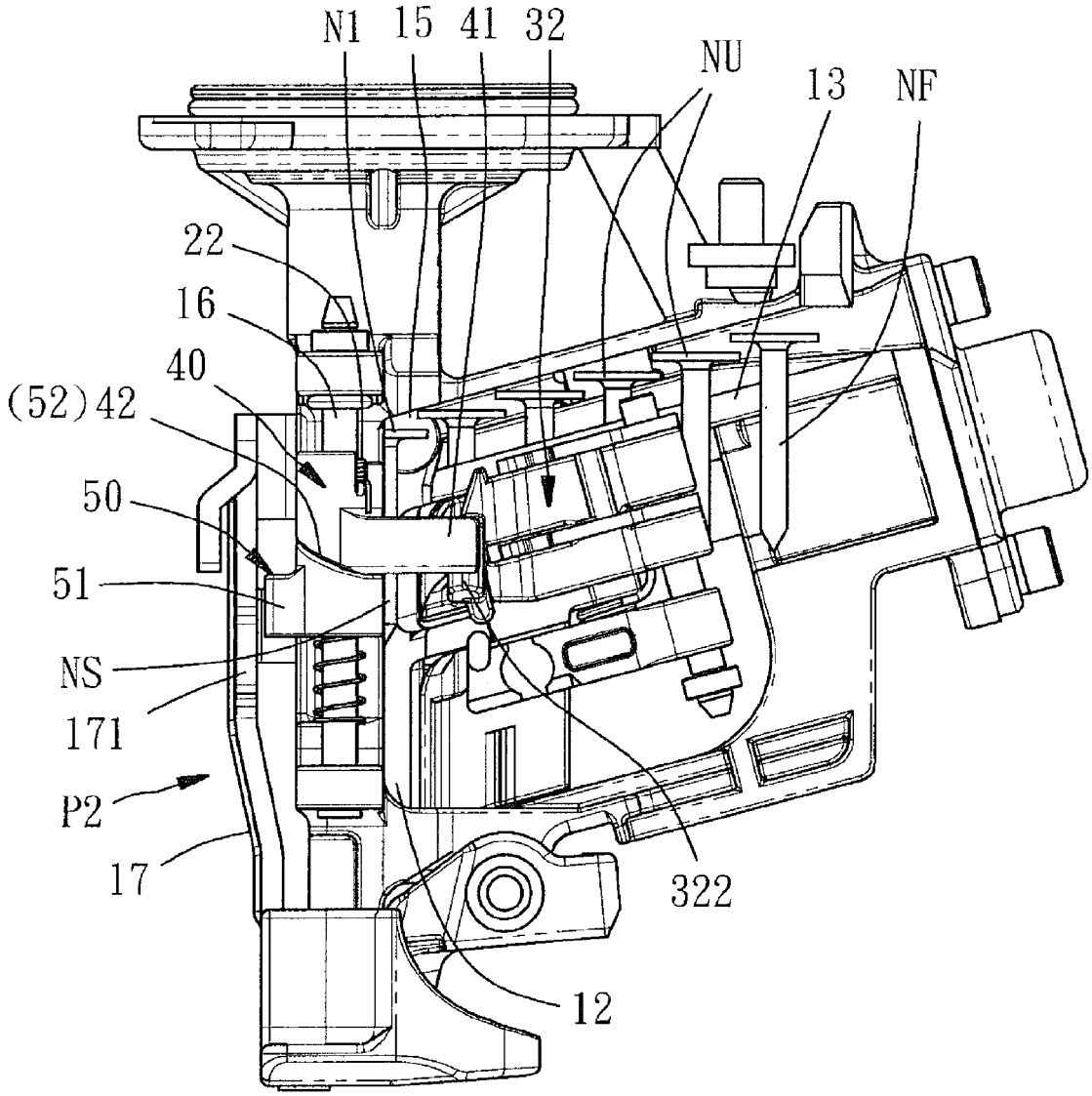
FIG. 9 is a schematic view of the preferred embodiment of the present invention, showing that the contact piece is stopped against the standby nails and the safety member is moved upward.

When at least one of the standby nails is still available in the nail passage 13, referring to FIGS. 8-9, the contact portion 321 is stopped against the at least one standby nail NU, and meanwhile the at least one standby nail NU pushes against the contact portion 321 to enable the contact piece 32 to pivot toward the nail passage 13, further enabling the push portion 322 to push the protrusion 41 to turn the transmission member 40 in such a way that the transmission member 40 drives the stopping member 50 and the stopping portion 51 via the second bevel 42 to turn to a second position P2 where the stopper 171 is not stopped. In this way, the safety member 17 can be forced to move upward for the purpose of firing the nail N.

In conclusion, the safe firing mechanism of the nail gun of the present invention depends on whether the standby nail is available or not, such that it will not happen like the prior art that the nail is not well positioned to disable accurate identification as to whether the nail is available or not. Besides, the present invention does not need to open the nail gun to remove the nail which is not well positioned, such that it is very convenient for the user to operate the nail gun of the present invention and the present invention is structurally simple. Further, while the nail-driving member of the present invention is moved, it does not directly percuss the contact piece, such that the contact piece and the transmission member of the present invention are not subject to wear and tear to enable high reliability of the nail gun.

Although the present invention has been described with respect to a specific preferred embodiment thereof, it is in no way limited to the specifics of the illustrated structures but changes and modifications may be made within the scope of the appended claims.

What is claimed is:

1. A nail gun having a safe firing mechanism, comprising:

a main body having a nail passage and a nail chamber in communication with the nail passage, the nail passage being provided for receiving a coil of nails, the nail chamber being provided for receiving the nails which are ready to be fired, the nails defining an initial nail, a final nail, and a plurality of standby nails located between the initial and final nails, the initial and final nails being located in the nail chamber;

a nail-driving member movably mounted in the nail chamber for percussing the nails in the nail chamber;

a safety member movably mounted to the nail chamber for upward or downward movement; and a linkage mounted to a side of the nail passage and having a contact portion and a stopping end linking up with the contact portion, the contact portion being spaced from the nail chamber for distance of at least one nail to be stopped against the standby nail, the stopping end being stopped against the safety member; when the contact portion is not stopped against the standby nail, the stopping end is not linked up to be located at a first position where the safety member is stopped from upward movement; when the contact portion is stopped against the standby nail, the stopping end is linked up to shift to a second position where the safety member is not stopped, wherein the linkage comprises an upper cover and a contact piece, the upper cover being located above the nail passage for being opened or closed relative to the nail passage, the contact piece being pivoted to the linkage; the contact portion is located at a bottom end of the contact piece; when the standby nail is stopped against the contact portion, the contact piece pivots to link up the stopping end, and wherein the linkage comprises a transmission member and a stopping member in the nail chamber; the stopping end is located at an end of the stopping member; the contact piece comprises a push portion formed at a top end thereof; when the standby nail pushes against the contact piece to pivot the contact piece, the push portion pushes the transmission member to move and then the transmission member drives the stopping member to move.

2. The nail gun as defined in claim 1, wherein the linkage comprises at least one compression spring having two ends, one of which is stopped against the upper cover and the other is stopped against the contact piece to keep the contact piece pivoting toward the nail passage.

3. The nail gun as defined in claim 1, wherein the transmission member and the stopping member are coaxially arranged and each comprise a bevel formed at a contact surface thereof, the bevel of the transmission member fitting that of the stopping member.

4. The nail gun as defined in claim 3, wherein the nail chamber comprises an axial pin mounted to a side thereof; the upper cover, the transmission member, and the stopping member are coaxially mounted to the axial pin.

5. The nail gun as defined in claim 4, wherein the linkage comprises a biasing member fitted to the axial pin, the biasing member having two ends, one of which is stopped against the upper cover and the other is stopped against the transmission member for providing a biasing force for the transmission member to keep stopped against the push portion of the contact piece.

6. The nail gun as defined in claim 4, wherein the linkage comprises a torsion spring fitted to the axial pin and having two ends, one of which is stopped against the upper cover and the other is stopped against the stopping member for providing a recovery force for the stopping member to keep stopped against the transmission member.

7. The nail gun as defined in claim 1, further comprising a magnet, wherein the magnet is mounted to the nail chamber for attracting and fastening the nails in the nail chamber.

8. The nail gun as defined in claim 7, wherein each of the nails defines a nail tip and a nail body, the nail tip being attached to the magnet.

* * * * *